US006492905B2

(12) United States Patent
Mathias et al.

(10) Patent No.: US 6,492,905 B2
(45) **Date of Patent: *Dec. 10, 2002**

(54) OBJECT PROXIMITY/SECURITY ADAPTIVE EVENT DETECTION

(75) Inventors: Keith E. Mathias, Ossining, NY (US); J. David Schaffer, Wappingers Falls, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/933,554

(22) Filed: Aug. 20, 2001

(65) Prior Publication Data

US 2001/0052851 A1 Dec. 20, 2001

Related U.S. Application Data

(63) Continuation of application No. 09/597,197, filed on Jun. 20, 2000.

(51) Int. Cl.[7] ..... G08B 21/00

(52) U.S. Cl. ..... 340/540; 340/568; 340/572; 340/522; 340/825.32; 340/825.34

(58) Field of Search ..... 340/540, 568, 340/572, 522, 825.32, 825.34

(56) References Cited

U.S. PATENT DOCUMENTS

| | | | | |
|---|---|---|---|---|
| 4,839,875 A | | 6/1989 | Kuriyama et al. | 369/14 |
| 4,881,061 A | | 11/1989 | Chambers | 350/568 |
| 5,260,690 A | * | 11/1993 | Mann et al. | 340/572 |
| 5,777,884 A | * | 7/1998 | Belka et al. | 340/825.3 |
| 5,886,634 A | * | 3/1999 | Muhme | 340/572 |
| 5,963,134 A | * | 10/1999 | Bowers et al. | 340/568.1 |

FOREIGN PATENT DOCUMENTS

| | | | |
|---|---|---|---|
| EP | 0724246 A2 | 7/1996 | G08B/13/24 |
| GB | 2332547 A | 6/1999 | G07C/9/00 |
| WO | WO9715031 | 4/1997 | G07F/7/06 |

* cited by examiner

*Primary Examiner*—Jeffery Hofsass
*Assistant Examiner*—Hung Nguyen
(74) *Attorney, Agent, or Firm*—Gregory L. Thorne

(57) ABSTRACT

A security system incorporating a reasoning system and security rules and processes. Transponders may be triggered and sensed from a distance to identify both items and individuals. These sensed identifiers are processed by the reasoning system to determine whether each identified item is authorized to be removed from or brought into a secured location by the identified individual. The system modifies and optimizes its rules and processes based on assessments of security events. The security system enforces these security rules and receives feedback from authorized security personnel. A learning system is configured to modify existing rules or create new rules in conformance with the feedback from the authorized security personnel.

7 Claims, 3 Drawing Sheets

OBJECT PROXIMITY/SECURITY ADAPTIVE EVENT DETECTION

CROSS REFERENCE TO RELATED APPLICATIONS

This is a continuation of application Ser. No. 09/597,197, filed Jun. 20, 2000.

BACKGROUND OF THE INVENTION

1. Field of the Invention

This invention relates to the field of security systems, and in particular to security systems that adaptively create and modify security rules and parameters based on prior events.

2. Description of Related Art

Security systems are common in the art. With the advent of computers and data base systems, inventory security systems are also becoming prevalent. PCT patent application WO 97/15031, "Article Inventory Tracking and Control System", published Apr. 24, 1997, discloses a system wherein each inventoried article is uniquely identified via a "marker". Users associated with the secured facility are also uniquely identifiable, via for example an identification card with a magnetic strip containing a unique identifier. The user places the inventoried article into a "checkout/check-in" device, along with the user's identification card. If the user is authorized to remove the device from the secured facility, the "marker" is switched to an inactive state. In a retail environment, the user is granted authorization to remove the device after a debit is registered to an account that is associated with the user's identification, such as a user's credit card account. Each egress from the secured facility contains a sensor for active markers. If an inventoried item's marker has not been inactivated, by the check-out/check-in device, the sensor will detect the active marker, and an alarm event is triggered to prevent the unauthorized removal of the item. In like manner, a user can return an inventoried item to the secured facility by presenting the item to the check-out/check-in device. When the inventoried item is checked in, the device reactivates the item's marker, and updates a database file to reflect the user's return of the inventoried item. A typical application of the system includes an automated check-out/check-in process for a lending-library, a video rental store, and so on. U.S. Pat. No. 4,881,061, "ARTICLE REMOVAL CONTROL SYSTEM", issued Nov. 14, 1989, operates similarly.

U.S. Pat. No. 5,886,634, "ITEM REMOVAL SYSTEM AND METHOD", issued Mar. 23, 1999, and incorporated by reference herein, provides a less intrusive system that uses radio-ID tags that are attached to people and items. A database associates each identified item with one or more people who are authorized to remove the item. When an item is detected at an exit without an authorized person, an alert is generated. The system also interfaces with inventory control systems, and can provide the capabilities discussed above, such as an automated check-in, check-out system.

In the prior art systems, the database of authorizations for each secured item in the inventory must be kept up to date. Because of the overhead that is typically associated with maintaining an inventory security system, the rules and processes that are enforced are relatively static and simple. Such a system may be well suited for a library or retail environment, wherein a convenience is provided relative to a conventional manned check-out station, but the same system may not be well received in an environment that is not normally secured.

In an office or laboratory environment, for example, employees are not typically subjected to security processes, even though theft of property does occur in these environments. This lack of security may be based on a reluctance to demonstrate a lack of trust to the employees; it may be based on the logistic difficulties, such as exit queues, caused by requiring each employee to check out inventoried items each time the items are removed from the secured facility; it may be based on the anticipated annoyances that false alarms may trigger; and so on. Similarly, in many large organizations, or large facilities, it may be infeasible to attempt to map each identified item in the facility with a set of the individuals who are authorized to remove the item.

BRIEF SUMMARY OF THE INVENTION

It is an object of this invention to ease the task of automating a security system. It is a further object of this invention to minimize the intrusion of security processes on monitored individuals. It is a further object of this invention to facilitate a dynamic modification of security processes invoked by a security system.

These objects and others are achieved by providing a security system that incorporates a reasoning system and security rules and processes that are designed to be as unobtrusive as the situation permits. Two independent aspects or the system facilitate the enforcement of rules and processes in an unobtrusive manner. First, transponders that can be triggered and sensed from a distance are preferably used to identify both items and individuals. These remotely sensed identifiers are processed by the reasoning system to determine whether each identified item is authorized, or likely to be authorized, to be removed from, or brought into, a secured location by the identified individual. Second, the system continually modifies and optimizes its rules and processes based on assessments of security events. An initial set of rules is created for the security system that, generally, prohibit the removal of secured items from the secured location, except that certain individuals are authorized to remove specified items from the secured location. Thereafter, the security system is configured to enforce these security rules and processes, and to receive feedback from authorized security personnel regarding the efficacy of the enforced security rules and processes. Coupled to the security system is a learning system that is configured to modify existing rules or create new rules, in conformance with the feedback from the authorized security personnel. By dynamically adjusting the security rules and processes, the intrusion of the security system on the monitored individuals is substantially reduced, and the system continues to be optimized based on feedback.

BRIEF DESCRIPTION OF THE DRAWINGS

The invention is explained in further detail, and by way of example, with reference to the accompanying drawings wherein.

Throughout the drawings, the same reference numerals indicate similar or corresponding features or functions.

DETAILED DESCRIPTION OF THE INVENTION

Figure 1:
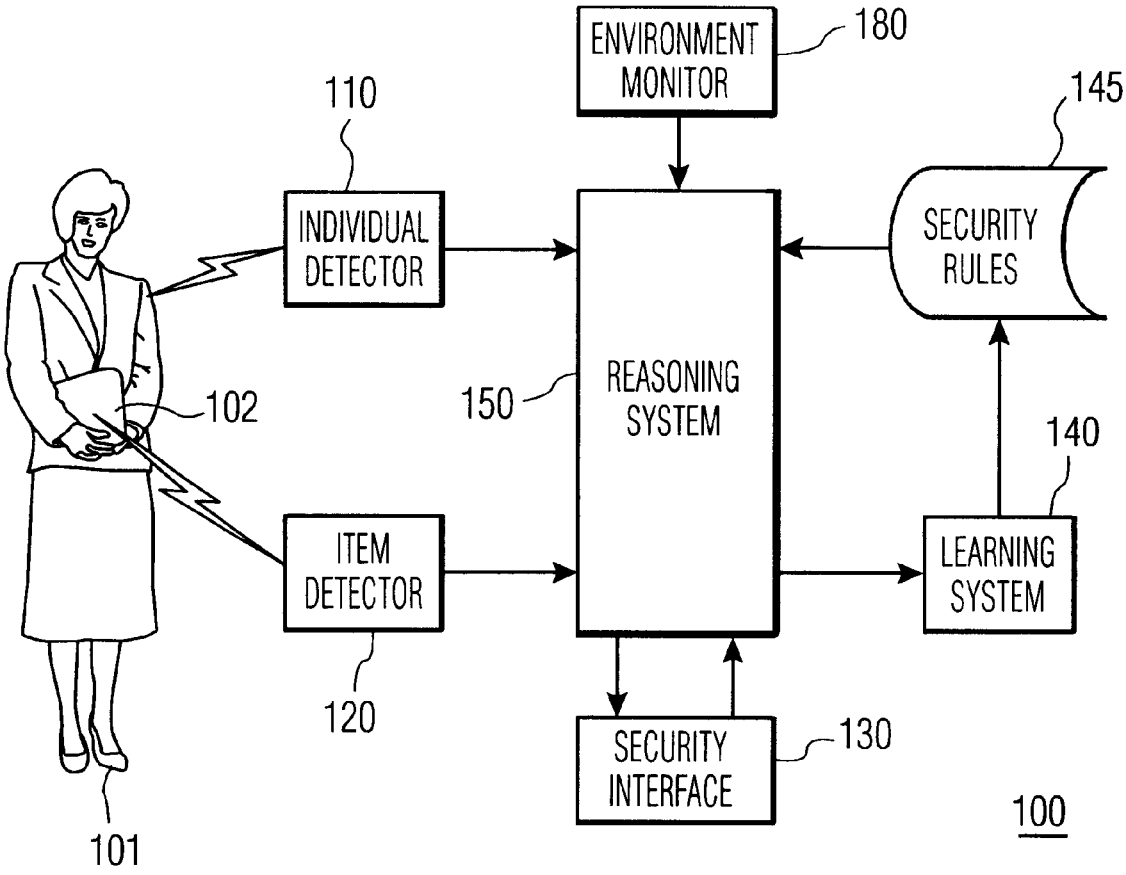
FIG. 1, illustrates an example block diagram of a security system in accordance with this invention.

FIG. 1 illustrates an example block diagram of a security system 100 in accordance with this invention. In a preferred embodiment, a transponder (not illustrated) is attached to an inventoried item 102, such as a portable computer system, a piece of office or laboratory equipment, and so on. Each egress from a secured location contains an area that is monitored by an item detector 120. Consistent with conventional transponder technology, the detector 120 emits a trigger signal in the vicinity of the monitored area. The detector 120 also detects emissions from the transponders that are triggered by the detector's trigger signal. Each transponder emits a unique code, and this unique code is associated with the inventoried item to which it is attached. The unique code from the transponder is provided to a reasoning system 150, via the detector 120.

In a preferred embodiment, another transponder (not illustrated) is attached to an individual 101, typically as a transponder that is mounted in a security badge. An individual detector 110 probes the monitored area and senses the emissions from the transponder, similar to the item detector 120, to determine a unique code that is associated with the individual 101. The unique code from the transponder is provided to the reasoning system 150, via the detector 110.

Note that independent detectors 110, 120 are illustrated for ease of understanding. A single detector system may be employed to detect transponders associated with either items or individuals. To avoid interference, or "collisions" in the response from both transponders, or from a plurality of transponders associated with multiple items 101, any number of conventional collision-avoidance techniques may be employed. The transponders may be configured to be triggered by different trigger signals. The item transponders may be triggered in one region of the monitored area, or at one time period, and the individual transponders may be triggered in another region, or at another time period. Alternatively, all transponders may be triggerable by the same trigger. In such an embodiment, each transponder, or each class of transponders, may be configured to transmit at a different frequency. Each-transponder may be configured to 'listen' for another transponder's response before initiating its own. Each transponder, or class of transponders, may be configured to transmit with a different delay time from the time that the trigger signal is received from the detector 110, 120. Each transponder, or class of transponders, may transmit using a different CDMA code pattern, and so on. Such techniques, and combinations of techniques, for distinguishing transmissions in a multi-transmitter environment are common in the art.

Other item and individual detection techniques may be used as well. For example, individuals may be recognized via machine vision systems, biometric recognition systems, and so on. In like manner, computer devices may be programmed to periodically transmit a beacon signal, and this beacon may be used to identify the computer item, or to trigger other security sub-systems.

Generally, the system 100 is configured to provide one or more item identifiers, via the detector 120, and at most one individual identifier, via the detector 110, to the reasoning system 150. Alternatively, if the monitored area allows the presence of multiple persons, localized detectors 110, 120 or direction-finding/location-determining detectors 110, 120 are employed to associate detected items with each person. If the environment is such that large items that require multiple people to transport are commonly encountered, the system 100 may be configured to provide multiple individual identifiers with each item identifier, as required. For ease of understanding, the invention is presented hereinafter assuming that each detected item identifier is provided to the reasoning system 150 with at most one individual identifier. Also, the system 100 is preferably configured to distinguish removals and returns of an item from and to the secured facility, to ease the subsequent processing tasks. Separate monitored areas can be provided for entry and exit, for example, or direction-determining detectors 110, 120 can be utilized. Alternatively, the system can be configured to initially set a flag associated with each inventoried item, indicating that the item is within the secured area, and then toggle the flag with each subsequent detection of the item at the entry/exit area, indicating each removal/return.

Figure 2:
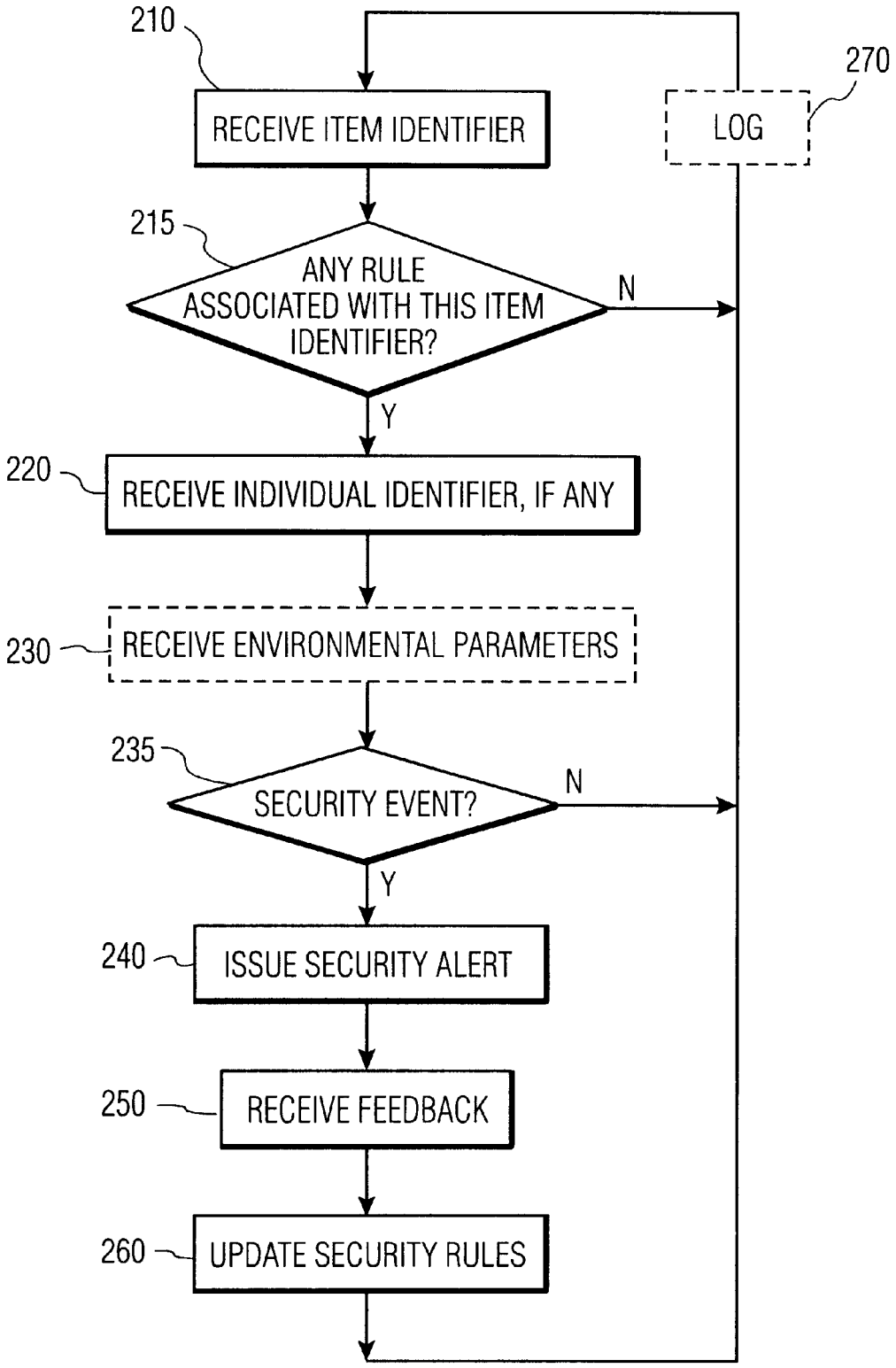
FIG. 2 illustrates an example flow diagram of a security system in accordance with this invention.

In a preferred embodiment, the reasoning system 150 processes the received item identifier and individual identifier based on a set of security rules 145, as illustrated by the example flow chart of FIG. 2. As illustrated by the continuous loop 210–260 in FIG. 2, the example reasoning system (150 of FIG. 1) continuously processes item identifiers that are received from the item detector (120 of FIG. 1). Upon receipt of an item identifier, at 210, the reasoning system determines whether any security rules (145 in FIG. 1) apply to the identified item, at 215. For example, some items, such as samples, may be identified for inventory purposes, rather than security purposes, and anyone may be permitted to remove such items from the secured location. If, at 215, a security rule applies, the individual identifier, if any, is received, at 220. As noted above, preferably a transducer is provided as part of a security badge. If the person (101 of FIG. 1) who is transporting the identified item (102 of FIG. 1) has such a badge, the person's identifier is received, at 220. If the person does not have a transponder, a null identifier is produced.

The security rules (145) include rules associated with each identified item, either as item-specific rules, item-class rules, general rules, and so on. A general rule, for example, is one that applies to all items, such as: "If any item identifier is received without an individual identifier, then issue alert A"; or, "If any item identifier is received between the hours of midnight and 5 a.m., and the individual identifier is not X, Y, or Z, then issue alert B". An item-class rule, for example, is one that applies to items having a specified classification, such as: "If any laboratory-class item identifier is received, and the individual identifier is not contained within the laboratory list, then issue alert C"; or, "If the cost associated with the item identifier is greater than $500, and the grade of the individual identifier is below grade X, then issue alert D". A specific rule, for example, is one that applies to the specific item, such as: "If item identifier x is received, and the individual identifier is not Y, then issue alert E"; or, "If item identifier Z is received, and the individual identifier is not within group A, then issue alert E". As would be evident to one of ordinary skill in the art, the rules may also include "else" clauses, "case" clauses, and the like, that further define security actions to be taken in dependence upon a correspondence or lack of correspondence between the identified item and the identified individual.

The term "alert" is used herein to include a result of a security evaluation. This alert may include sounding an audible alarm, sealing egress points from the secured facility, turning on a video camera, telephoning a remote security site, sending an e-mail to a select address, and so on. In a typical embodiment for an office or laboratory environment, the alert will typically include displaying a message on a display console, for potential subsequent action by security personnel, to avoid the unpleasant effects of a false alarm, or an over reaction to a minor discrepancy. In some installations, an authorized removal of an identified item may also trigger an alert, the alert being an "OK to remove" report to security personnel, for example. Note also that the principles of this invention are not limited to security systems. The terms "security system", "alert", and the like are used for ease of understanding. For example, the system 100 may be used in a field service facility having a limited inventory of certain pieces of test equipment, and a person X could create a rule such as: "If anyone returns an item identifier corresponding to an oscilloscope type item, then issue an alert to X". In like manner, the system 100 may be used in conjunction with other systems, such as a messaging system, and a rule could be structured as: "If the item identifier is X, and the individual identifier is Y, then send any messages in the messaging system for individual Y to the X device." Similarly, the monitored area could contain an audio output device, and a rule could state: "If the individual identifier is Y, then Say 'John, please call Bill before you leave'. " Or, ". . . then play message Y1." These and other applications of a system 100 having remote item and individual sensing capabilities will be evident to one of ordinary skill in the art in view of this disclosure. Note that the "If then . . . " construct of the above example rules is provided for ease of understanding. As is common in the art, a variety of techniques are used for effecting a choice based on a plurality of inputs, such as neural networks, fuzzy logic systems, transaction systems, associative memory systems, expert systems, and the like.

The security rules may be based on context or environmental factors, such as the day of the week, the time of day, the state of security at the facility, and so on. The state of security may include, for example, whether an alarm has been sounded, whether the alarm is a security or safety alarm, and so on. That is, for example, the removal of any and all items may be authorized when a fire alarm is sounded, whereas the removal of select classes of items may be precluded when an intrusion alarm has been sounded. If so configured, these environmental factors are provided by an environment monitor (180 of FIG. 1) and received by the reasoning system (150 of FIG. 1) at block 230, in FIG. 2.

If a security event is triggered by the combination of item identifier, individual identifier (if any), and environmental parameters (if any), the appropriate alert is issued, at 240. Discussed further below, feedback based on the alert is received, at 250, and this feedback is used to update the security rules, at 260. After updating the rules, at 260, or if a security event is not triggered, at 235, or if there are no rules associated with the identified item, at 215, the process loops back to block 210, to receive the next item identifier. Optionally, at 270, a log of the effects caused by each received item identifier is maintained, for subsequent review and critique by security or management personnel.

In accordance with another aspect of this invention, the security system 100 of FIG. 1 includes a learning system 140 that is configured to modify the security rules 145 that are used by the reasoning system 150. The learning system 140 modifies the security rules 145 based on feedback received in response to alerts, via the security interface 130. The learning system 140 attempts to optimize the performance of the security system by reinforcing correct behavior of the reasoning system 150, and discouraging incorrect behavior.

In many large organizations, or large facilities, it may be infeasible to attempt to map each identified item in the facility with a set of the individuals who are authorized to remove the item. The operation of a security system in such an environment will be dependent upon the policies of the organization. In a non-automated environment, for example, some organizations will enforce a mandatory search of all packages being removed from a secured facility. Other organizations will enforce a "spot check" search of packages being removed. When either system is first employed at the organization, inefficiencies are commonplace. As the security staff gains experience, the system runs more smoothly. Certain people become recognized; the type of items that they normally have authority to remove becomes known; and so on. Certain items are discovered as being particularly popular theft items, such as computer accessories, while other items are discovered as being popular remove-and-return items, such as special purpose test equipment, and so on. It is recognized that most current security systems are not foolproof. The security staff experience is relied upon to provide a reasonable and efficient tradeoff between the need to maintain security and the inconveniences produced by the security system. Generally, security resources are best spent on unusual occurrences, rather than routine occurrences, even though a devious thief could take advantage of the reduced security devoted to routine occurrences.

In accordance with this aspect of the invention, the learning system 140 emulates the learning behavior of the security staff, with the added advantage of knowing the items being removed from or brought into the facility. Using techniques common in the art, the learning system 140 receives feedback from the reasoning system 150, based on, for example, a security person's assessment of an issued alert from the reasoning system 150, via the security interface 130. When the security system 100 is first installed, for example, many alerts will be issued. The security person will take some action on all or some of the alerts, such as asking select identified individuals 101 for evidence of authorization for removing items 102, or checking with the individual's supervisor for such authorization, and so on. Typically, these are the same actions that the security person would take in a non-automated system, except that the individuals targeted for such spot checks will be known to be transporting secured items 102, thereby increasing the efficiency of these spot checks (regardless of whether a learning system is employed).

To further improve the efficiency of the security operation, in accordance with this aspect of the invention, the security person reports the results of the spot check to the reasoning system 150. The reasoning system 150 processes this feedback into a form suitable for processing by the learning system 140. For example, the reasoning system 150 provides the learning system 140 with the specific 'input stimuli' (individual identification, item identification, environmental factors, and so on) that initiated the security process, the rules that were triggered, the alerts that were issued, and the evaluation of the alert (authorized, unauthorized). The feedback may also include a 'strength value' associated with the evaluation (confirmed, unconfirmed), or other factors that may be used by the learning system 140 to affect subsequent alert notifications, discussed further below.

Figure 3:
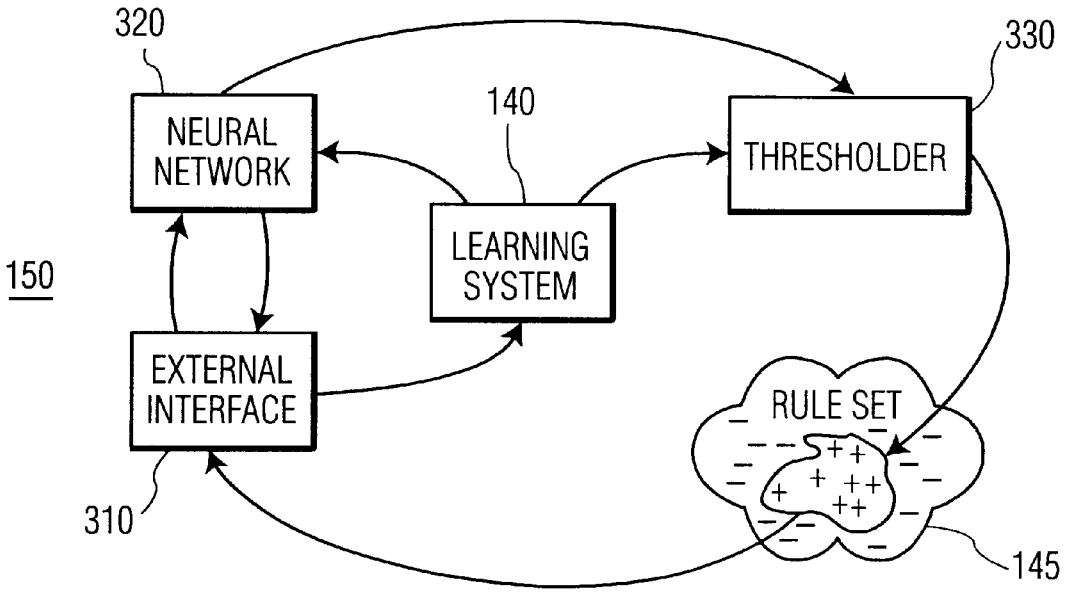
FIG. 3 illustrates an example block diagram of a learning system for use in a security system in accordance with this invention.

FIG. 3 illustrates an example flow diagram for updating a rule set via a learning system, in accordance with this invention. The example reasoning system 150 is illustrated in FIG. 3 as comprising an external interface 310, a neural network 320, and a thresholder 330. The external interface 310 receives the item and individual identifications from the detectors (110, 120 of FIG. 1), provides the alerts to the security personnel, receives the feedback based on the alerts, and so on. In the example of FIG. 3, a neural network 320 is illustrated for effecting the 'reasoning' operation of the reasoning system 150. A neural network 320 traditionally includes a network of nodes that link a set of input stimuli to a set of output results. Each node in the network includes a set of 'weights' that are applied to each input to the node, and the weighted combination of the input values determines the output value of the node. The learning system 140 in this example embodiment processes the feedback from the external interface 310 of the reasoning system 150 to adjust the weights of the nodes so as to reinforce correct security alert determinations (alerts that resulted in "unauthorized" removal determinations), and to reduce the likelihood of providing incorrect security alert determinations (alerts that resulted in "authorized" removal determinations). As noted above, the feedback may include factors that determine how strongly the particular feedback information should affect the nodal weights within the neural network 320. For example, certain high-cost items may require a formal authorization process, such as a manager's signature on a form, or an entry in the security rules database 145, and so on. The "unauthorized" feedback to the learning system for a person who would be otherwise authorized to remove the item, but who failed to follow the formal authorization process, would typically be structured to have less effect on the nodal weights of the neural network 320 than an "unauthorized" feedback regarding a person who was truly unauthorized to remove the item. In like manner, the-cost of the item, or the status of the individual within the organization hierarchy, may be used by the learning system 140 to determine the effect of the feedback on the nodal weights.

Also associated with a typical neural network 320, or other system that is used for determining an output based on multiple inputs, is a thresholder 330 that provides an assessment as to whether the output produced warrants the triggering of an alert. The neural network 320 may be configured to provide a set of likelihood estimates for parameters that are assumed to be related to whether a theft is occurring. The thresholder 330 processes these somewhat independent outputs to determine whether or not to issue an alert. As is common in the art, and as the name implies, the thresholder 330 may include a set of threshold values for each parameter, and may trigger an alert if any parameter exceeds its threshold. Alternatively, the thresholder 330 may form one or more composites of the parameter values and compares each composite with a given threshold value. Commonly, fuzzy-logic systems are employed within thresholding systems. As illustrated in FIG. 3, the example learning system 140 may also use the feedback from the reasoning system 150 to affect the threshold values, to further reinforce correct reasoning, and/or to reduce incorrect reasoning. In like manner, a genetic algorithm may be used to determine effective parameters and threshold values, based on an evaluation of the effectiveness of prior generations of parameters and threshold values.

The overall effect of the learning system 140 is to refine the rule set 145, or to refine the conclusions produced by the rule set 145, so that the set of input events that trigger an alarm (identified by "+" signs in the rule set 145) eventually have a high correlation with events that are indicative of a potential theft, and so that the set of input events that do not trigger an alarm ("−" in rule set 145) have a high correlation with authorized events. In this manner, the number of alerts that need to be processed by the security personnel are potentially reduced, and potentially focused on true security-warranted events.

Note that, similar to an experienced security staff, the security system and learning system are configured to learn which events are "ordinary", or "usual", so that the "extraordinary", or "unusual" events become readily apparent. In a home environment, for example, the security system may be configured to define and refine rules based on consistent behavior. If someone in the household routinely takes a trombone from the home every Thursday morning, for Trombone lessons in the afternoon, the learning system can create a 'rule' that is correlated to this event. If, on a subsequent Thursday morning, the person is detected leaving the home without the trombone, the system can issue an alert, based on this 'inconsistent' event. In this example, the security system alerts the person to the absence of the trombone, using a notification device, such as an intercom speaker at the exit. In like manner, in an office environment, if a person brings an umbrella into work in the morning, the security system can remind the person to bring it home in the afternoon.

A variety of techniques may be employed to effect the detection of inconsistent events. In a preferred embodiment, a bi-directional associative memory (BAM) is used, wherein parameters describing the person, the person's privileges, the object, the environment (i.e., day of year, day of week, time of day, temperature, and so on), and the location are encoded in a vector representation suitable for input to a BAM. The BAM is then trained to recognize these patterns, preferably using gradient search methods. The patterns chosen would be those representing normal situations; techniques common in the art can be used to automate the identification of 'normal' or frequently occurring events and to correlate factors associated with these events. As is known in the art, a BAM is particularly well suited for determining the closest vector that is contained in the BAM to an input vector. In this example, the vectors in the BAM represent a normally observed situation, and the input vector represents the current sensed situation. If the current sensed situation corresponds to a normal situation, the closest vector in the BAM to this current sensed situation will match the input vector. If the current sensed situation corresponds to an abnormal situation, the closest vector in the BAM will not match the input vector. In this example, if one or two of the parameters in the current sensed situation do not match the encoding of a particular normal situation, but a substantial number of other parameters do match this particular normal situation, this normal situation will be identified as the closest vector, and the mismatching Parameters will identify an abnormal event.

Figure 4:
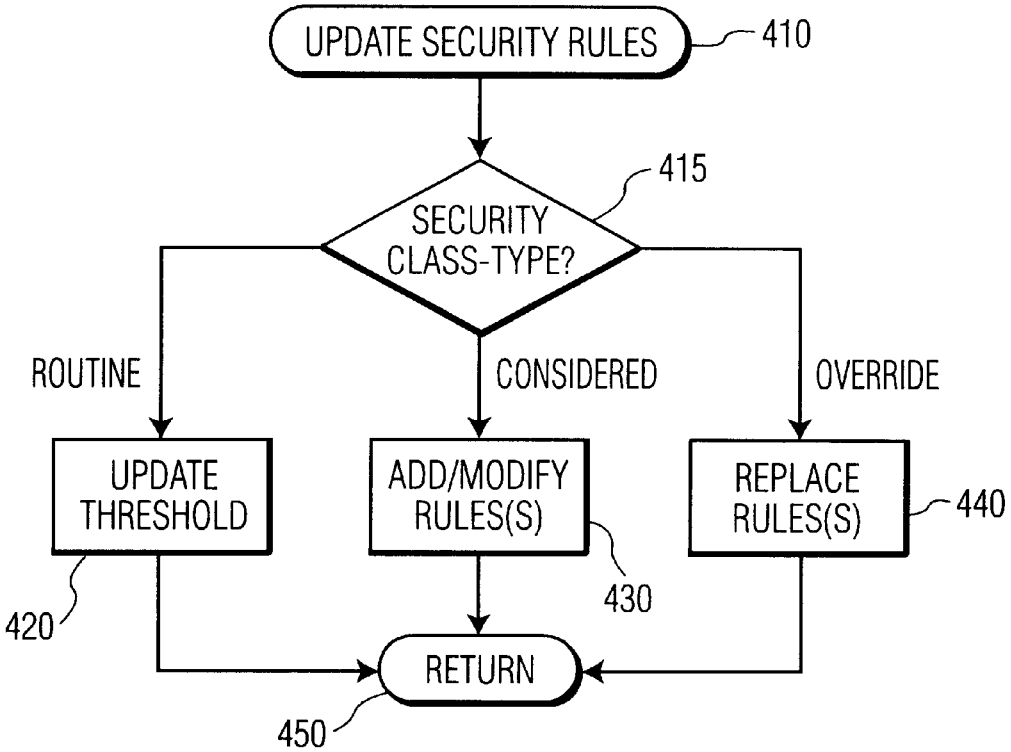
FIG. 4 illustrates an example flow diagram for updating a security system rule set in accordance with this invention.

The above learning-system process is indicated in FIG. 2 at blocks 250 and 260. Feedback is received, at 250, and the security rules are updated, at 260. FIG. 4 illustrates an example flowchart corresponding to the updating 260 of the security rules. As illustrated in FIG. 4, in a preferred embodiment, different types of feedback are supported, at 415. In this example, three types of feedback are illustrated: 'routine' feedback, 'considered' feedback, and 'override' feedback. As will be evident to one of ordinary skill in the art, other types of feedback, and combinations of types of feedback, can also be supported. In this example, 'routine' feedback is, for example, the result of a cursory spot check in response to an alert, or in response to the absence of an alert. In this example embodiment, a routine feedback affects only the thresholds used to trigger an alert, at 420. A 'considered' feedback, on the other hand, may be feedback that is generated based on a thorough review of the transaction log, or by an input of the feedback by a senior security official, and so on. Because the 'considered' feedback is assumed to be more reliable than 'routine' feedback, the learning system uses the 'considered' feedback to update the rule set, at 430. An override feedback, on the other hand, supercedes existing rules, at 440, and may be provided during emergencies, typically for a limited duration. Other types of feedback, such as 'management' feedback, 'administrative' feedback, and the like, may also be employed, wherein, for example, a new employee is given authority to remove certain items, former employees are prohibited from removing any items, and so on. As mentioned above, other feedback types, not related to security, may also be supported, such as a 'message' type that can be used to send a message to an individual, or an item associated with the individual, when the individual arrives at the monitored area.

Note also that the paradigm of a rule based system is also presented for ease of understanding. Other architectures and techniques are also feasible. For example, the reasoning system 150 may be "agent based", wherein each agent represents an item or an individual. The individual agents would each have an initial rule set, and would have an ability to learn behavior, such as routine entry and exit procedures, and thereby be able to notice and report abnormal behavior. The item agents would have the ability to check databases for individual's authorized to remove the item, or the ability to initiate an account logging procedure. Agents may also be designed to operate in conjunction with other agents. For example, one item may be an "authorization pass" whose item agent is an "authorization agent". The authorization agent operates to prevent, or decrease the likelihood of, an alert that would normally be generated, absent the concurrent presence of the authorization pass.

The following example illustrates a typical scenario that can be supported by the system as described above.

The example system collects the following parameters: an item_ID, a person_ID (optional), a day_of_week, a time, and an enter/leave code, every time an object containing one of the proximity-triggering ID tags enters or leaves a secure facility.

The example system also partitions events into two regions; allowed and disallowed events This can be accomplished by having a set of rules that distinguishes allowed and disallowed events, for example, rules prepared and maintained by a security staff.

To provide an ability to build up a picture of "usual" allowed events, so that special notices may be issued when unusual events occur, even though they are not disallowed, the following steps are performed:

1. Define an event similarity measure. For example a "usual-event" template can be defined as any set of at least K events that share at least M features. In the aforementioned 'trombone' example, the event history may reveal K events with item_ID=trombone, person_ID=Hugo, dayof_week=Thursday, type=exit.
2. Specify an algorithm to define a fuzzy family membership function that captures the pattern in the features that do not match exactly. An example of such a fuzzy family membership function might be:

2*a*) for categorical items (e.g. item_ID), OR the values observed to form an item_ID set;

2*b*) for ordinal items (e.g. day_of_week), bracket the interval of the values observed to form a defined range;

2*c*) for continuous items (e.g. time), define a triangular family membership function with its peak at the mean of the observed values and going to zero at some small distance outside the extreme values observed. In the trombone example, the distribution of times that Hugo leaves on Thursdays with his trombone may be observed to have a mean of 18:30 and has no observed values outside the interval 18:17 to 18:35.

3. Specify one or more less restrictive event similarity measures to be used for comparing new events to the usual-event templates. An example might be a match on at least n-1 features where n is the number of features that define the aforementioned usual-event template. In the trombone example, an observed event of person_ID=Hugo, day_of_week=Thursday, type=exit, time=18:20 and item_ID=null matches the fuzzy membership criteria for this less restrictive similarity measure, but differs from the usual-event template (no item_ID corresponding to the trombone).
4. Specify a notice to be issued dependent upon the usual-event similarity measure and the less restrictive event similarity measure. For example, if the differing item is the item ID, then issue an alert suggesting that the item has been forgotten.

As can be seen, by providing "generic" definitions and rules, i.e. definitions such as "at least n-1 features" to define a less restrictive event, and rules such as "If less-restrictive-event but not a usual-event, and item_ID does not match, then send a forgotten-item alert", the system in accordance with this invention can provide alerts corresponding to specific events that are not literally encoded in the rules database. Contrarily, in a conventional database system, specific rules regarding each item, for example, the trombone, would need to be explicitly included in the database.

The foregoing merely illustrates the principles of the invention. It will thus be appreciated that those skilled in the art will be able to devise various arrangements which, although not explicitly described or shown herein, embody the principles of the invention and are thus within its spirit and scope. For example, the advantages provided by a learning system that modifies security rules based on feedback from security events can be achieved independent of the means used to identify the item and/or the individual. That is, conventional card readers, UPC code readers, biographical scanners, pattern recognition systems, image processing systems, and the like can form the detectors 110, 120 that are used to identify items or individuals. In like manner, the advantages provided by the use of remote transponders can be achieved independent of the means used to maintain or update the rules that are enforced. That is, for example, a conventional data base management system may be used by the reasoning system 150 to associate items with individuals who are authorized to remove the items, or a conventional rules based system may be employed, without the use of a learning system 140. In like manner, although the security system is presented herein as a system that restricts the unauthorized removal of items from a secured facility, the system can also be used to restrict the unauthorized entry of items into the secured facility. If, for example, transponders were mandated to be installed in all firearms, the system could be used to prevent the transport of a firearm into a secured area, except by authorized personnel. These and other system configuration and optimization features will be evident to one of ordinary skill in the art in view of this disclosure, and are included within the scope of the following claims.

We claim:

1. A program portion stored on a processor readable medium for a security system, the program portion comprising:

a program segment arranged to receive identification information on an item and a person;

a program segment arranged to generate an alert in dependence upon the identification information and a set of security rules; and a program segment arranged to receive feedback associated with the alert and modify the set of security rules based upon the feedback.

2. The program portion of claim 1, wherein the identification information for each of the item and the person includes an associated unique identifier.

3. The program portion of claim 1, wherein the program segment arranged to receive identification information is arranged to receive identification information from at least one of:

a transponder associated with at least one of the item and the person;

a card that is associated with at least one of the item and the person;

an image of at least one of the item and the person; and a characteristic that is embodied in at least one of the item and the person.

4. The program portion of claim 1, wherein at least one of the program segments comprises at least one of a neural network, an expert system, an agent system, an associative memory, a genetic algorithm, a fuzzy logic system, and a rule-based system.

5. The program portion of claim 1, wherein the program segment for modifying the set of security rules is arranged to modify the set of security rules based on at least one of:

a time of day, a day of a week, a temperature, a direction of movement of at least one of the item and the person, a presence of an other item, a presence of an other person, and a state of security.

6. The program portion of claim 1, wherein the program segment for modifying the set of security rules is arranged to modify the set of security rules based on a class-type associated with the feedback.

7. The program portion of claim 6, wherein the class-type includes at least one of routine, considered, temporary, absolute, and override.

* * * * *